United States Patent [19]

Thelissen

[11] Patent Number: 5,066,931

[45] Date of Patent: Nov. 19, 1991

[54] FILTER CONNECTOR WITH LATCHABLE MOUNTING FRAME

[75] Inventor: Guillaume Francois G. Thelissen, RG 'S-Hertogenbosch, Netherlands

[73] Assignee: E. I. du Pont de Nemours and Company, Wilmington, Del.

[21] Appl. No.: 584,162

[22] Filed: Sep. 18, 1990

[30] Foreign Application Priority Data

Sep. 29, 1989 [NL] Netherlands ..... 8902429

[51] Int. Cl.[5] ..... H01R 13/658

[52] U.S. Cl. ..... 333/182; 333/185; 439/620

[58] Field of Search ..... 333/182–185; 439/607–610, 620, 544, 547, 549, 557, 562, 565, 567, 76

[56] References Cited

U.S. PATENT DOCUMENTS

| | | | |
|---|---|---|---|
| 3,530,426 | 9/1970 | Snyder | 439/557 |
| 4,212,510 | 7/1980 | Ritchie et al. | 439/90 |
| 4,791,391 | 12/1988 | Linnell et al. | 333/184 |
| 4,959,626 | 9/1990 | Mouissie | 333/182 |
| 4,983,935 | 1/1991 | Mouissie | 333/185 X |

FOREIGN PATENT DOCUMENTS

| | | |
|---|---|---|
| 8715632 | 2/1988 | Fed. Rep. of Germany . |
| 2283564 | 3/1976 | France . |

*Primary Examiner*—Eugene R. LaRoche
*Assistant Examiner*—Seung Ham

[57] ABSTRACT

A filter connector comprising a filter unit and a metal frame for releasably mounting said filter connector to the metal chassis of electrical apparatus. The mounting frame is formed of electrically conducting material, comprising a flat base plate with feed-through apertures for the contact elements and is provided with resilient mounting lips which project relative to said base plate for latchably mounting the filter connector in a self-latching manner on a chassis.

5 Claims, 1 Drawing Sheet

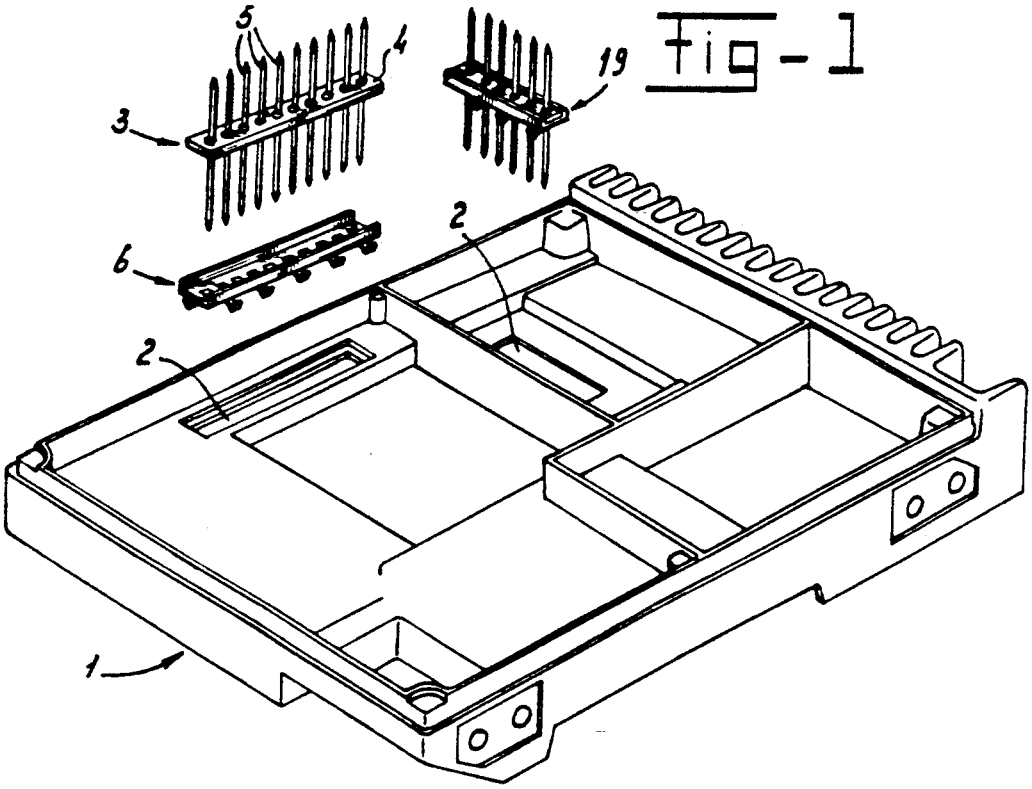
Fig-1
Fig-2
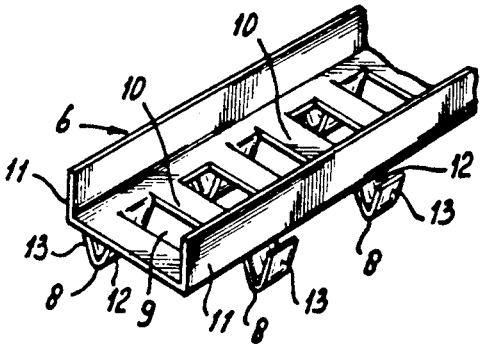
Fig-3
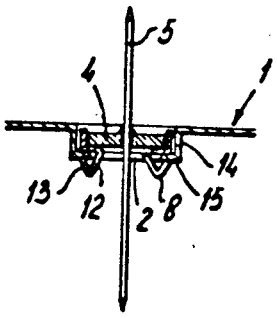
Fig-4
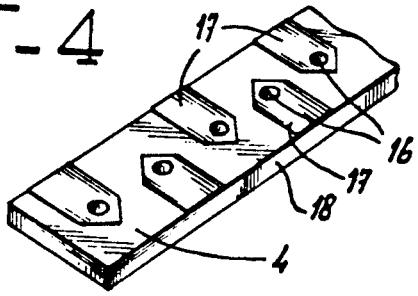

FILTER CONNECTOR WITH LATCHABLE MOUNTING FRAME

BACKGROUND OF THE INVENTION

This invention relates to filter connectors and, more particularly to a filter connector with a latchable mounting frame.

Electronic circuits for use in, for example, motor vehicles have to meet high standards as regards shielding against interference signals. The interference signals produced in an automobile while it is running extend over a broad frequency range, i.e., from a few Hz to several MHz.

Filter connectors are commonly used in motor vehicles to suppress interference signals which occur between interconnections of various electronic units. Copending U.S. patent application Ser. No. 07/318,149, filed Mar. 2, 1989 and assigned to the same assignee as the present application, describes a filter connector with effective shielding against interference signals of relatively low frequency and with a filter unit having filter capacitors which suppress interference signals of relatively high frequency. The filter unit is similar to that also disclosed in assignee's U.S. Pat. No. 4,791,391 wherein the filter capacitors are separately formed on an alumina substrate around a plurality of apertures. A pin terminal is mounted in each aperture and is an electrical contact with the filter capacitor surrounding that aperture. A ground electrode is formed around the periphery of the substrate.

Such filter connectors are normally mounted to a grounding chassis. It is advantageous that the filter connectors be easily mountable and removable for repair. One means of mounting such filter connectors in a motor vehicle is disclosed in U.S. patent application Ser. No. 07/370,836 filed June 23, 1989, also assigned to the same assignee as the present application and now abandoned. In this application, the filter unit substrate of the filter connector is mounted with one of its flat side in contact with the chassis. This accomplished through the use of a holder or frame of electrically conducting material which engages the other flat side of the filter unit substrate. The frame has mounting lips which can be bent over to secure it to the chassis. The chassis in the aforenoted application is formed of two dish shaped shells of sheet metal between which electronic components are disposed for shielding against interference signals.

For effective shielding against interference signals, it is desirable for the filter unit substrate to be in electrical contact with the chassis to which it is mounted along the entire periphery of the filter unit substrate. When the chassis is formed of sheet metal, such as disclosed in the aforenoted U.S. application Ser. No. 07/370,836, this is generally easy to achieve since the surface of sheet metal can be formed with sufficient accuracy by means of pressing or punching. Surface accuracy is important to avoid undesirable mechanical stresses on the filter substrate when it is mounted. This is particularly important in the case of substrates of ceramic material such as alumina, which are generally fairly brittle and are thus susceptible to cracks and breakage.

Sheet metal chassis cannot be used for car telephones such as modern cellular telephones. Filter connectors are important in such car telephones to provide electric coupling between the transmitter and receiver housing parts, which are fitted in separate, shielded compartments. In the case of such car telephones, cast aluminum parts are used for the chassis. Since all openings and mounting faces are made by casting, machine finishing of the mounting faces to obtain a desired surface accuracy for mounting filter connectors is too expensive in practice. Mounting the filter connector for effective shielding is therefore considerably more difficult when a case metal chassis is used.

SUMMARY OF THE INVENTION

It is an object of the invention therefore to provide a filter connector with a mounting frame for mounting the filter connector in an opening provided for it in a cast metal chassis without the need for a finishing operation on the cast surface of the chassis or the need for screw fastenings and the like.

This is accomplished according to the invention by a mounting frame which is provided at side of a baseplate with resilient mounting lips which project relative to the plane of the baseplate at such an angle so as to mount the filter connector in a self-latching manner in an opening on the chassis.

The mounting lips have two functions. Firstly, they absorb any height differences in the surface of the chassis near the opening in which the filter connector is to be mounted. Secondly, they provide electrical contact between the frame and the chassis. When mounted, the filter substrate lies near the periphery of the feed-through aperture, with a flat side on the other flat side of the baseplate of the mounting frame. This flat, baseplate side of the mounting frame is formed with a surface accuracy which is desired for achieving the necessary electrical and mechanical contact between the substrate and the mounting frame.

An embodiment of the filter connector according to the invention which is particularly advantageous for mounting has mounting lips which at their projecting free end are in a form which is bent over backwards through an angle of more than ninety degrees in the direction away from the respective boundary edges of the feed through aperture to accommodate clamping of the chassis between the side of the baseplate and the backward bent end of the mounting lips.

A filter connector according to the present invention may be mounted simply by placing the mounting frame with the mounting lips at one side of the chassis in front of the appropriate opening therein. By subjecting the frame to a pressure force in the direction of the opening, the mounting lips will tilt slightly towards each other and pass through the opening, and will then return under the influence of their own resilience to their initial position, in which the bent back ends of the mounting lips in question act upon the other side of the chassis. This produces a sturdy, self-latching, clamping fixing of the filter connector to the chassis. The filter connector with its mounting frame can easily be removed from the chassis again by moving the lips towards each other.

Although the mounting lips can extend over the entire periphery of the mounting frame, it has been found that a fastening which is sufficiently mechanically stable for many purposes is obtained if the mounting lips are disposed near at least two opposite boundary edges of the feed-through aperture.

An embodiment of the filter connector which is particularly advantageous to manufacture provides mounting lips which are integral with the mounting frame and are formed from the material of the baseplate at the feed-through aperture. The mounting lips in question can be obtained by, for example, punching out of the baseplate. The opening so made in the baseplate provides feed-through apertures for the contact elements of the filter connector.

The baseplate of the mounting frame must not go askew during fitting due to height or thickness differences of the chassis near the opening which receives the filter connector. This is detrimental to the electrical connection of the filter unit substrate to the mounting frame and could cause undesirable mechanical stresses to be exerted on the substrate. This is prevented in a further embodiment of the invention which provides that the feed-through aperture is formed by slot-type apertures which are situated corresponding to the pitch distance of the contact terminal elements. The mounting lips extend alternately from one or the opposite boundary edge of the feed-through apertures.

It will be clear that the baseplate in this embodiment is mechanically sturdier than in an embodiment in which the baseplate is provided with a single feed-through aperture for a contact terminal which extends over the distance of all contact elements. The latter is shown in the above-mentioned U.S. application Ser. No. 07/370,836.

Yet another embodiment of the filter connector according to the invention provides that the baseplate of the mounting frame has lateral edges projecting at right angles to the other side thereof to accommodate the filter substrate between them. Such raised sides have a beneficial effect on the mechanical rigidity of the mounting frame.

The invention also relates to a mounting frame of the type described above. The use of such a mounting frame is, of course, not necessarily limited to substrates provided with filter elements, but it can be used for easy and efficient mounting of any connector of this type.

The invention is explained in greater detail below with reference to a preferred embodiment of the filter connector shown in the drawing.

BRIEF DESCRIPTION OF THE DRAWING

FIG. 1 shows schematically in perspective a part of a cast metal housing, with apertures for the accommodation of filter connectors, and a filter connector in assembled and unassembled state;

FIG. 2 shows schematically in perspective, on an enlarged scale, a part of the mounting frame of the filter connector according to the invention;

FIG. 3 shows schematically in cross-section a filter connector according to the invention, mounted on a chassis.

FIG. 4 shows schematically the filter unit substrate of FIGS. 1 and 3.

DETAILED DESCRIPTION OF THE EMBODIMENTS

A cast metal housing 1 such as shown in perspective in FIG. 1 is used typically for car telephones. In order to prevent undesirable signal transfer between the transmitter and receiver parts of such a car telephone, both the transmitter and the receiver parts are accommodated in separate metal housing parts, each of which is cast from aluminum.

To electrically interconnect the transmitter and receiver parts to each other, filter connectors are used. The housing part 1 has openings 2 for receiving the filter connectors. This housing acts as the chassis to which the filter connectors are to be mechanically and electrically connected.

A filter connector 3 according to the invention is shown in an unassembled state. The filter connector 3 has an oblong substrate 4 of for example, alumina, on which filter capacitor elements 17 are formed as shown in FIG. 4. The filter substrate 4 has a plurality of contact pins 5 which project on either side of the substrate through holes 16 formed in the substrate 4. Each filter capacitor element 17 surround a hole 16 so that each contact pins will be in electrical contact with a filter capacitor element 17. Contact may be achieved, for example, by soldering. A common ground electrode is formed along the peripheral edge of the substrate 4. As noted earlier, a substrate with filter elements of this type is more specifically described in U.S. application Ser. No. 07/318,149 and U.S. Pat. No. 4,791,391.

A mounting frame 6 is provided for mounting of the substrate 4. Filter connector 19 of FIG. 1 is shown in the assembled state mounted to the frame 6. Instead of the pin-shaped contact elements 5 shown, socket contact elements or combinations of pin and socket contact elements can also be used.

FIG. 2 shows a portion of the mounting frame 6 of FIG. 1, on an enlarged scale. Projecting from one side of the flat, oblong baseplate 7 are mounting lips 8 which are formed by punching out the material of the baseplate 7. The slot-type apertures 9 thus formed in the baseplate 7 provide feed-through apertures for the contact elements 5. The distance between the mounting lips 8 and between the apertures 9 corresponds to the pitch distance between the contact elements 5. The remaining transverse connecting sections 10 of the baseplate 7 increase the mechanical sturdiness of the mounting frame 6 as a whole. In order to prevent sagging in the lengthwise direction of the mounting frame, the baseplate 7 is provided with raised edges 11, as shown. These raised edges 11 are also used for positioning of the substrate 4.

In a preferred embodiment of the invention, the mounting lips 8 are disposed alternately along opposite lateral side edges of the baseplate 7. The mounting lips 8 have a bent-over backwards shape at their free end. A part 12 of each mounting lip 8 which is connected to the flat baseplate 7 projects from the bottom of the baseplate at an angle relative to the plane of the baseplate, in the direction towards the plane of a corresponding edge 11. A projecting free end 13 of each mounting lip is bent backward through an angle of over ninety degrees. The backward bent part 13 of each mounting lip 8 ends a specific distance from the baseplate 7 for the purpose of clamped fixing to one or more of the boundary edges 14 of the opening 2 in the cast metal chassis housing 1. The boundary edge 14 is clamped between the bent end 13 of the mounting lip and the bottom side of the baseplate 7 from which the mounting lips 8 extend, as shown partially in cross-section in FIG. 3.

The filter connector according to the invention can be mounted by positioning the mounting lips 8 opposite the opening 2 and by exerting a pressure force downward to and through the opening 2. Under the influence of this pressure force, the mounting lips 8 move towards each other until the end of the backward bent part 13 engages with the flat undersurface 15 of the boundary edge 14 of the opening 2 in the metal housing chassis 1. The mounting lips 8 exert a spring force due to their own resilience to return to their initial position. Thickness differences in the chassis 1 at the opening 2 cause the mounting lips 8 to return to a greater or lesser extent to their initial position.

With a mounting frame according to the invention, thickness differences in a cast chassis can be absorbed in an effective way, and the substrate 4 of the filter connector can be mounted mechanically stress-free and electrically connected all round via the peripheral ground electrode 18 to the mounting frame. The ground common electrode 18 can thereby be connected electrically and mechanically to the mounting frame 6, either to the baseplate 7 and/or the raised edges 11 by means of soldering.

The invention is of course not restricted to the preferred embodiment shown in the drawing, but can be modified in many different ways. For example, the number and position of the mounting lips 8 on the layout of the filter substrate 4 could be modified. The use of the filter connector described is, of course, not restricted to car telephones or cast housings, but can in general be employed to facilitate mounting of any connector in or near an aperture in a chassis without the need for separate mechanical fixing means.

I claim:

1. A filter connector adapted to releasably latch in a metal chassis of an electrical apparatus comprising a filter unit formed of a flat substrate of electrically insulating material having a plurality of filter capacitor elements formed on at least one side thereof, a plurality of contact elements extending through apertures in said substrate aligned with said filter capacitor elements, each of said contact elements being in electrical contact with one of said filter capacitor elements, a common ground electrode formed along at least one of peripheral lateral side edges of said substrate, and a mounting frame of electrically conducting material having a flat base with a plurality of apertures therein corresponding to said contact elements, said filter unit being secured to said mounting frame so that a bottom surface of said flat substrate rests adjacent a top surface of said flat base and the contact elements extending from said bottom surface of said flat substrate pass through said respective corresponding apertures in the flat base, said common ground electrode being in electrical contact with said mounting frame, a plurality of resilient mounting lips formed integrally with said flat base, each said mounting lip extending away from a bottom surface of the flat base at an angle so as to extend beyond the planes of one or the other of the respective lateral peripheral sides of the flat base, whereby when the filter connector is inserted through an aperture in the metal chassis, said mounting lips are resiliently flexed inward toward said planes of said lateral peripheral side of the substrate until fully inserted into the chassis aperture when said mounting lips return to their initial position to releasably latch and electrically connect said filter connector to said metal chassis.

2. A filter connector according to claim 1 wherein a mounting lip is formed at each aperture in said mounting frame base, said aperture having opposite side edges and said mounting lips extending alternately from one or the other of said aperture side edges toward the plane of the lateral side of the base nearest to said respective aperture side edge.

3. A filter connector according to claim 1 wherein a free end of each mounting lips is bent through an angle of more than ninety degrees so that it extends toward the plane of the flat base to provide an edge to latchably engage an inner surface of the chassis within said chassis aperture.

4. A filter connector according to claim 1 wherein said mounting frame has extending upward from the top surface of said base at its lateral peripheral sides a pair of lateral side edges, said filter unit substrate disposed in said top surface between said side edge and said common ground electrode electrically contacting said side edges.

5. A filter connector according to claim 1 wherein said chassis is formed of cast metal.

* * * * *